US005414909A

United States Patent [19]

Kielty

[11] Patent Number: 5,414,909

[45] Date of Patent: May 16, 1995

[54] SELF-OPENING CLOTHING FASTENER DEVICE

[75] Inventor: Mark C. Kielty, San Cristobal, N. Mex.

[73] Assignee: James Reid, Ltd., Sante Fe, N. Mex.

[21] Appl. No.: 99,355

[22] Filed: Jul. 30, 1993

[51] Int. Cl.[6] ..... A44B 5/00

[52] U.S. Cl. ..... 24/97; 24/102 R; 24/102 PL; 24/106

[58] Field of Search ..... 24/97, 98, 99, 100, 24/100.5, 102 F, 102 T, 90 A, 90 B, 90 HA, 102 R, 102 PL, 106, 41

[56] References Cited

U.S. PATENT DOCUMENTS

| | | | |
|---|---|---|---|
| 524,277 | 8/1894 | Jones . | |
| 701,244 | 5/1902 | Amburn . | |
| 712,426 | 10/1902 | Vogel . | |
| 811,901 | 2/1906 | Case | 24/97 |
| 977,925 | 12/1910 | Benincasa . | |
| 1,194,041 | 8/1916 | Larrabee | 24/97 |
| 1,209,624 | 12/1916 | Rusha . | |
| 1,333,228 | 3/1920 | Stuart . | |
| 2,105,287 | 1/1938 | Lewy | 24/97 |
| 2,270,677 | 1/1942 | Cronan | 24/102 PL |
| 2,396,668 | 3/1946 | Anderson | 24/102 R |
| 2,501,151 | 3/1950 | Bayardi . | |
| 2,586,434 | 2/1952 | Marien . | |
| 2,596,357 | 5/1952 | Anderson . | |
| 3,080,630 | 3/1963 | Paliotta | 24/97 |
| 3,350,749 | 11/1967 | McIntyre | 24/97 |

FOREIGN PATENT DOCUMENTS

| | | | |
|---|---|---|---|
| 0212118 | 2/1957 | Australia | 24/97 |

*Primary Examiner*—Victor N. Sakran
*Attorney, Agent, or Firm*—Hoffman, Wasson & Gitler

[57] ABSTRACT

A fastening device for securely and reliably joining parts of clothing, such as shirt collars, shirt cuffs, or the like. The fastening device is adapted to be inserted through a sturdy and preformed opening in the clothing, such as a buttonhole. The device incorporates a sturdy base member having a stem and a bar-like clothing engaging head which is biased by springs. The head pivots so as to grip the clothing parts to be joined, while the springs firmly position the head in a parallel orientation to the base member, with the parts of clothing to be joined captured therebetween. The springs also provide automatic pivoting of the head so that the device can be conveniently and easily used one-handedly. The device may be ornamentally decorated with distinctive and visually appealing insignia.

15 Claims, 3 Drawing Sheets

SELF-OPENING CLOTHING FASTENER DEVICE

BACKGROUND OF THE INVENTION

1. Field of the Invention

The instant invention pertains to clothing fastening devices, such as cuff links and the like.

2. Discussion of the Prior Art

Throughout time, man has been concerned about the adornment of the human body. Such adornment includes the wearing of jewelry, distinctive hairstyles and most significantly, the wearing of clothing. When it comes to the wearing of clothing, which is well known to come in various styles and arrangements for both men and women, it is necessary to securely fasten the clothing upon the wearer's body. Among the already well known methods of fastening clothing, and also the various devices for performing the fastening function, it appears that buttons and hooks are the most popular, reliable and economical.

To date, however, there has not been a particularly useful, expedient or attractive manner to fasten shirt cuffs, although valiant attempts have been made. One such attempt is demonstrated by U.S. Pat. No. 2,501,151 to Bayardi, who discloses a cuff link comprising a shank having a bar-like or elongated head pivotally mounted at one end, a fixed head rigidly connected to the opposite end of the shank, and a helical coil spring. The spring is positioned around a pivot pin inside the head.

Another attempt is demonstrated by U.S. Pat. No. 2,586,434 to Maien, who discloses a cuff link comprising a post, an end portion, a fixed head, and a pivoted head. The end portion of the post is provided with ears and coiled springs.

Another attempt is discussed in U.S. Pat. No 2,596,357 to Anderson, which concerns a cuff link including a U-shaped shank having spaced arms, a snap retaining head pivotally mounted on a pivot bar, and a spring assembly.

A further attempt is shown by U.S. Pat. No. 712,426 to Vogel, which is directed to a button for collars and cuffs comprising a shoe and a shank. The shoe is pivoted to the end of the shank to facilitate passing the shoe through the buttonhole or cuff hole.

Unfortunately, none of the prior art patents teaches one-handed insertion and removal of a cuff link. Nor do any of the prior art patents present a cuff link that is prevented from slipping out of its buttonhole in a reliable manner. It has been found that cuff links tend to fall out of the buttonhole due to their inadvertent twisting.

SUMMARY OF THE INVENTION

Accordingly, it is an object of the instant fastening device to provide a simple, reliable and economic way to secure parts of clothing.

It is another object of the instant fastening device to provide an easy to manufacture and comfortable to wear device for securing parts of clothing.

It is a further object of the instant fastening device to provide a distinctive and attractive device for fastening shirt cuffs.

It is yet another object of the instant fastening device which is adapted for one-hand insertion and removal.

These and other objects will become readily apparent by reference to the following detailed description, which sets forth the best mode, when considered in connection with the accompanying drawings, which are herein incorporated.

BRIEF DESCRIPTION OF THE DRAWINGS

FIG. 3 shows a front elevation of the fastening device.

DETAILED DESCRIPTION OF THE PREFERRED EMBODIMENT

Figure 1:
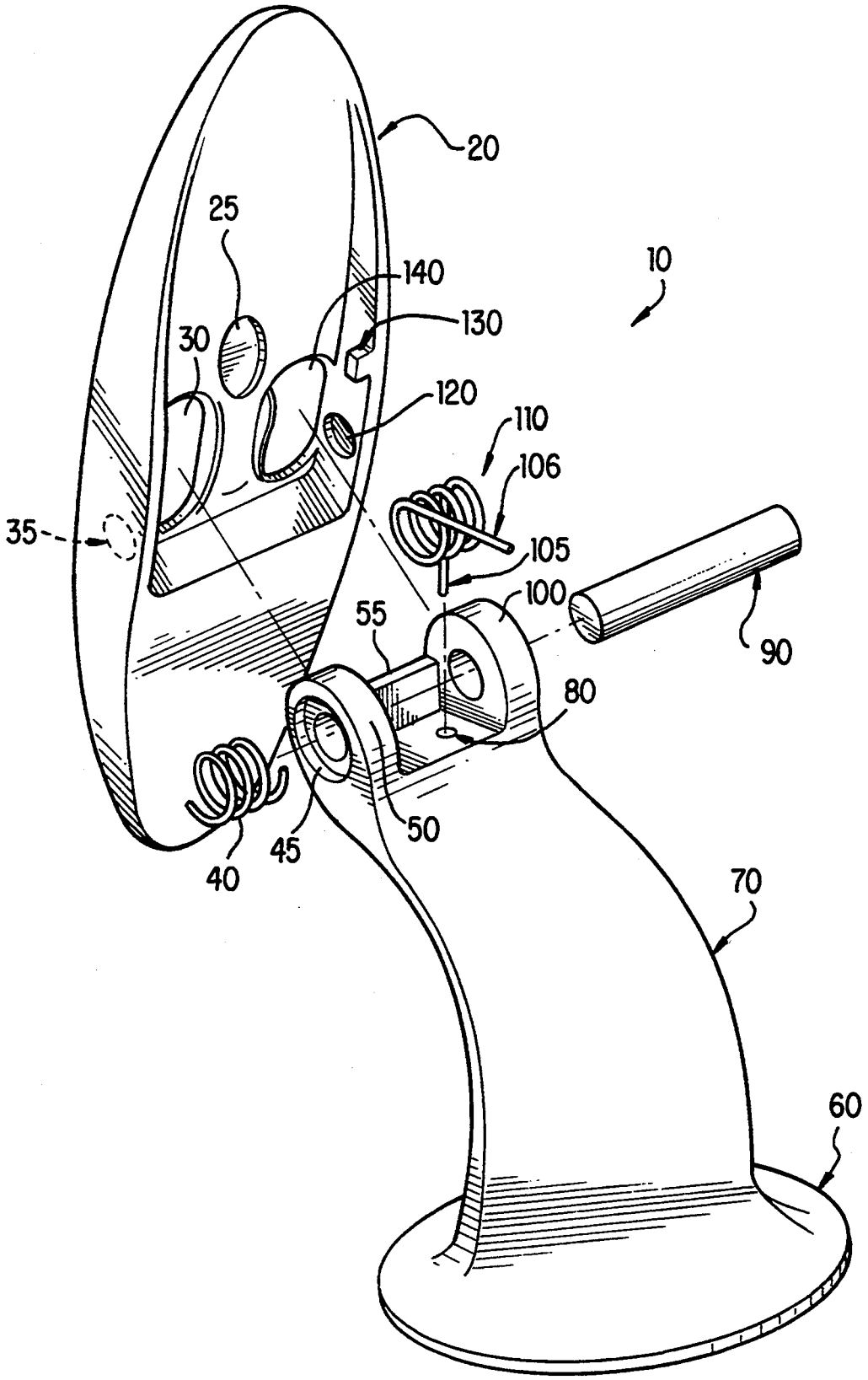
FIG. 1 shows an exploded view of the fastening device.

A discussion of the preferred embodiment of the fastening device 10 will now be made with reference to FIG. 1, where the head 20 of the device is shown in an exploded position, away from the remainder of the device 10. Elliptically shaped openings 30,140 are provided in the head 20 to allow positioning of lobes 50,100 respectively, of a shank portion 70 of the device 10. The shank region 70 will be discussed in greater detail later. The head 20 is further provided with first and second pivot points 35,120 respectively, and an integral snap 130. The snap 130 falls into a congruent depression (not shown) on the shank region 70 and serves to hold the head 20 parallel to the shank 70 so as to allow handy manipulation of the fastener device through a buttonhole. As can clearly be seen in FIG. 1, the head 20 incorporates a generally scooped out or recessed region 25 in the area between the openings 30,140. The head 20 is slightly offset from the shank region 70 so as to allow the head 20 to lay substantially flush or parallel with the shank region 70. The shank region 70 will be discussed in greater detail later. Snap 130 retains the head 20 in a position parallel to the shank region 70, such that the head 20 lays flush or parallel with the shank region 70. The pivot points 35,120 provide an axis about which the head 20 pivots, so that, with the mechanical support of a hinge pin or rod 90, the head 20 is both supported upon the shank 70 and allowed to rotate freely and smoothly. It should be noted that pivot point 35 is closed ended, that is to say, that once the pivot rod 90 is seated, the point 35 cannot allow the pin or rod 90 to pass out. On the other hand, the pivot point 120 is open ended to allow ease of assembly. The head 20 stays in the position perpendicular to the shank 70, or the head 20, once so oriented, stays in the position parallel with the shank 70. In the configuration shown in FIG. 1, and also shown in FIG. 3, it can be seen that the head 20 rotates about the hinge pin or rod 90, in one direction. The one-directional rotation of the head 20 is insured by a pivot stop 55, which bears against a corresponding region of the head 20 when a greater than permissible rotation is attempted. However, it is well within the contemplation of the present fastening device that the head 20 may also pivot in either the opposite direction, or in both directions, so long as the fastening device 10 is capable of serving in its primary purpose of securely fastening layers or pieces of clothing, namely shirt cuffs and the like.

So, to carry out this purpose, the head 20 must be small enough to easily pass through the buttonhole, or other suitable opening, of the clothing layers or pieces of clothing to be joined, while at the same time, the head 20 must be large enough not to inadvertently fall out of the buttonhole or other opening, once inserted therethrough. This purpose is assisted by the fact that the head 20 is offset slightly from alignment with the base 60. The device 10 is prevented from inadvertently becoming dislodged and falling out of a buttonhole by a twist of the shank region 70.

Also shown in FIG. 1 are first and second springs 40,110, which resiliently bias the head 20 in an orientation that facilitates one-hand insertion through a buttonhole, but prevent dislocation. The springs will be discussed later. Regardless of the type of springs 40,110 shown here, both or either of the springs may be any other type of resilient biasing element. Whatever type of biasing element is used, the spring 110 must be capable of holding the head 20 substantially perpendicular to the shank region 70, a position alternatively referred to as the open position, and to this end a torsion spring provides the greatest degree of strength and durability. Spring 40 must be capable of holding the head 20 substantially parallel to the shank 70, a position alternatively referred to as the closed position, and to this end either a closed end coil spring or a ground end coil spring provides sufficient strength, due to the inherent pushing ability of coil springs. However, it is well within Applicant's contemplation that spring 40 may be a disk spring or a spring washer.

The first spring 40 is loosely seated in a well 45 formed on the side of a first lobe 50, the lobe 50 being formed on the remote end of the shank portion 70. The inner diameter of the spring 40 is greater than the diameter of the hinge pin or rod 90 to allow insertion of the pin or rod 90 through the coil length of the spring. The spring 40 bears against the pivot point 35 and the side walls of the well 45. The outer diameter of the spring 40 must be less than the diameter of the well 45, such that the spring 40 is held in place and positioned within the well 45. It should be noted that the spring 40 does not perform a clutching action between the lobe 50 and the corresponding area of the head 20, because such clutching action would tend to interfere with smooth and efficient operation of the device 10. The spring 40 complements the action of the snap 130, once the snap 130 is received in its depression (not shown) which is located on the lobe 100, in holding the head 20 in the position that is flush with or parallel to the shank region 70.

Turning next to the second spring 110, which, similar to spring 40, is disposed around the hinge pin or rod 90, but at a location that is central to the first lobe 50 and a second lobe 100. A significant part of the spring 110, which includes two ends joined by coils of sufficient number to provide the requisite torsion needed to hold the head 20 in a position substantially perpendicular to the shank region 70, will now be identified and discussed. A brace 105 forms one end of the spring 110, extending from the coils, the brace 105 sits firmly within a spring set 80 which is formed in the top portion of the shank region 70, at a position near the second lobe 100. The brace 105, along with the hinge pin or rod 90, provide mechanical support and positioning for the entire spring 110. A lever 106 emerges from the other end of the spring 110. The lever 106 bears against the underside of the head 20, in the previously discussed recessed region 150. The lever 106 of the spring 110 is held in place upon the underside of the head against its own tension and also by ridges integral with the walls of the openings 30,140. During normal wear, the biasing action of the spring 110 holds the head 20 in an orientation suitable for keeping the various clothing pieces worn by user joined together.

Now the shank region or portion 70, along with a base 60 will be discussed. The shank region or portion 70 serves to hold the head 20, via the action of the springs 40,110 and the hinge pin or rod 90, in a useful position. Thus, it is essential that the lobes 50,100, which are integral with the shank 70, be suitably formed so as to accommodate the aforementioned components. The shank 70 including the lobes 50,100, is formed of a unitary piece of material, preferably a metal such as sterling silver, but a molding of almost any of the modern thermoplastics or even wood would be suitable. The shank 70 is provided with a slight angle or twist, laying in one plane, to offer both the maximum ease of insertion through a buttonhole, and the most reliable fastening strength and holding power.

The shank 70 extends from, and is integral with, a base 60. Now, the base 60 preferably takes the same size and dimensions as the head 20, so as to offer the maximum degree of reliability and holding power. The base 60 is shaped for ease of manufacture and also for ease of accommodation for a decorative piece, which will be discussed later.

It should be noted that the shank 70 is formed so as to have dimensions that can be accommodated by the buttonhole through which the instant fastening device is inserted, while not inducing unnecessary stress on the fabric. Thus, the shank is both wide and twisted so as to counteract the effect of the tendency to become accidentally unseated and dislodged.

Figure 2:
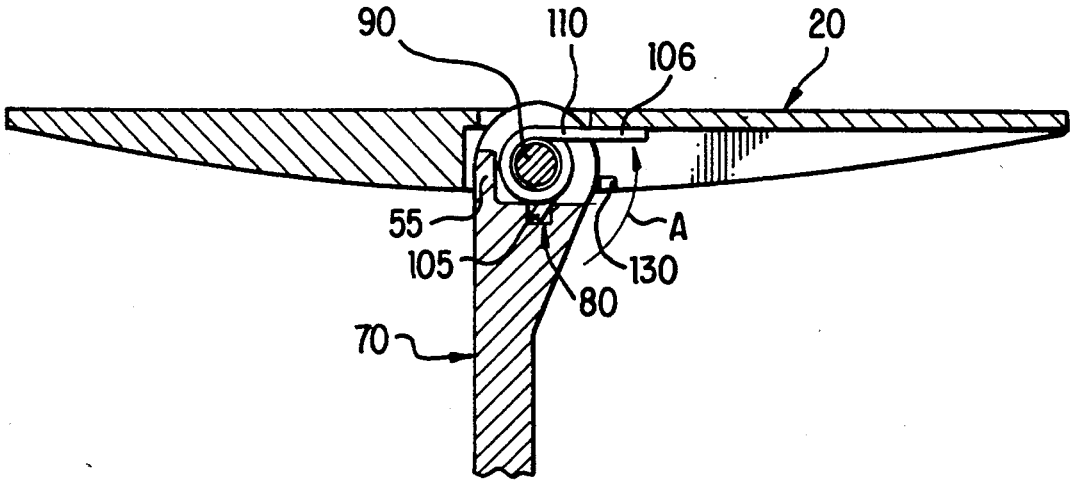
FIG. 2 shows a sectional view of the fastening device.
Figure 3:
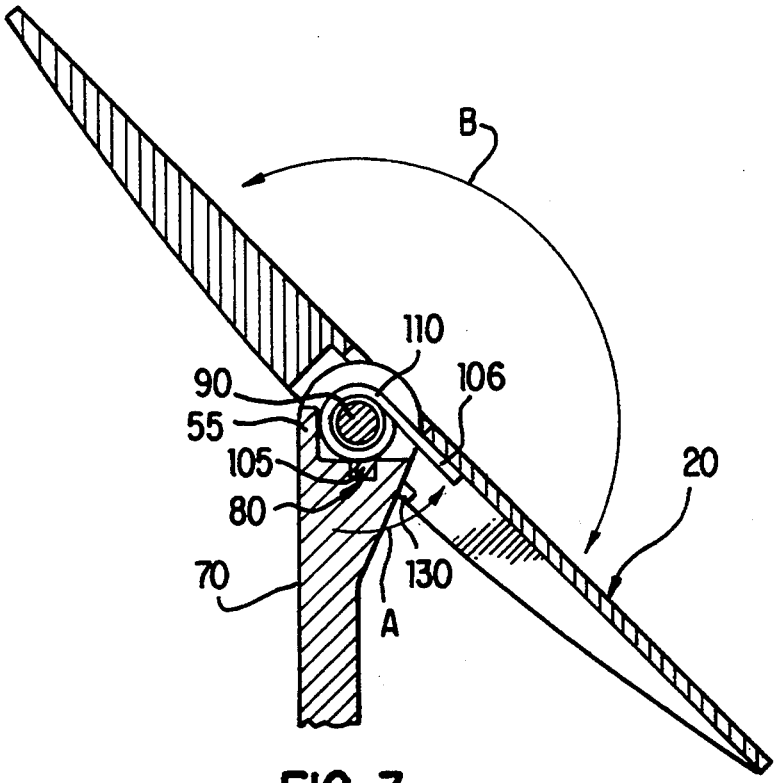
FIG. 3 shows a sectional view of the fastening device.

FIGS. 2 and 3 provide a view of the pivotal arrangement of the head 20, with respect to the shank 70. Looking first at FIG. 2, the lever 106 of the second spring 110 is shown in its operable position bearing against the region 25 on the underside of the head 20. The hinge pin or rod 90 is shown in its position passing through the coils of the spring 110. The brace 105 of the spring 110 is shown seated within the set 80. The snap 130 is also clearly shown, such that it is readily apparent that the function of the snap 130 is to engage a depression (not shown) on the lobe 100, when downward pivotal rotation of the head 20 reaches its maximum. The downward pivotal rotation is demonstrated in FIG. 3. Note the manner and location in which the snap 130 approaches the depression (not shown). Too great of a reversed rotation is prevented by the stop 55.

The arrow A in FIGS. 2 and 3 illustrates the urging action of the spring 110 upon the underside of the head 20 so as to bring the head 20 into a horizontal position that is relatively perpendicular to the shank 70.

The arrow B in FIG. 3 shows the manner in which the head 20 pivots. It can readily be appreciated that the hinge pin or rod 90 is the axis around which the head 20 moves. FIG. 3 provides an excellent demonstration of the tensioning of the spring 110. It is from this tensioned position that the fastening device is inserted through a buttonhole.

Spring 40 is relaxed until the head 20 is rotated in a direction toward the shank region 70 at which point the spring 40 develops sufficient tension to force the stop 130 into the depression (not shown). The depression is located proximate the lobe 100 in an area adjacent to the shank region 70. The depression receives the snap 130 so as to hold the head 20 in position for insertion through the buttonhole. The action of the snap 130 is mechanically secure enough to overcome the restorative force of the spring 40. Lobe 100 has a slightly rounded edge adjacent to the depression, so as to prevent the snap 130 from binding.

The lobes 50 and 100 are rounded, both for attractive presentation, since they protrude partially through the openings 30,140, and also so as not to interfere with the rotation of the head 20. Rounding begins at a location just below the visible surface of the lobes 50 and 100, such that the rounding does not appear to be visible through the openings 30,140.

Figure 4:
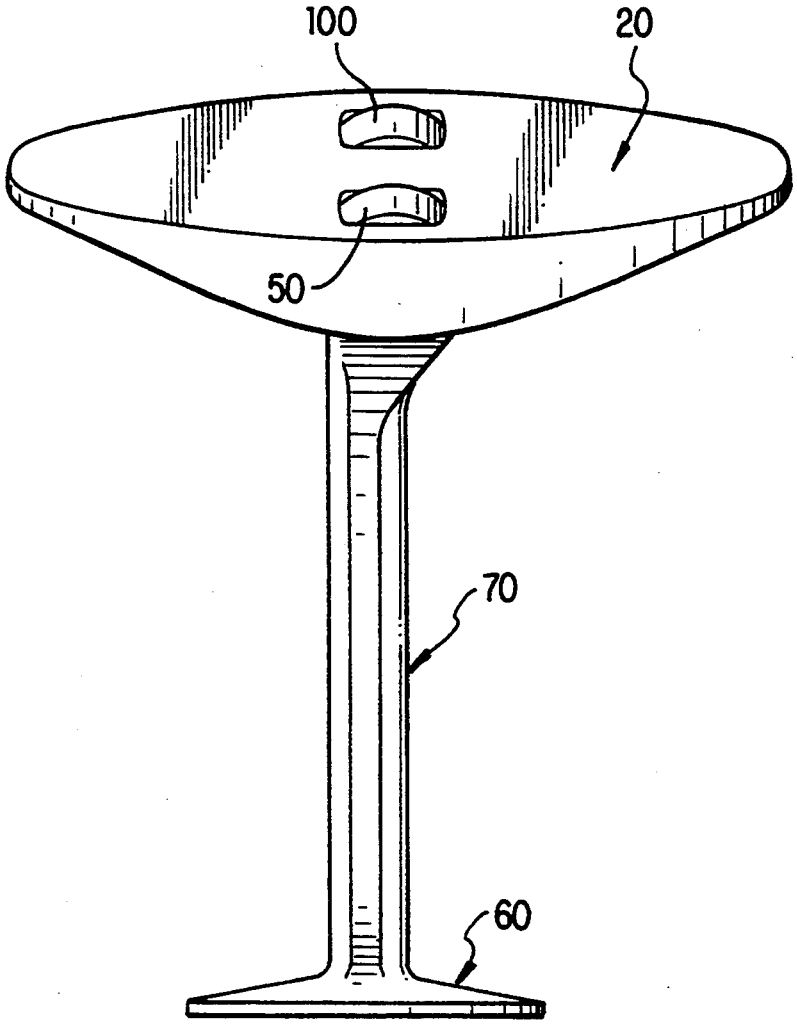

FIG. 4 shows the fastening device 10 as it would appear before the head 20 is pivoted. Just prior to insertion through a buttonhole, such as in a shirt cuff, the head 20 is pivoted to a position flush with the shank 70. The base 60 as well as the shank region 70, with its slight cant, relative to the base 60 are clearly shown. Portions of the lobes 50,100 which protrude through the top of the head 20 are also clearly shown. Applicant envisions that the top of the head 20 can be provided with decorative insignia or ornamentation, which would cover the exposed portions of the lobes 50,100. The decorative insignia or ornamentation would be secured to the head via a reliable adhesive, but the adhesive should not interfere with the pivotal action of the head 20. Or, the decorative insignia or ornamentation could conceivably be attached by a mechanical system, such as screws , rivets or the like, which penetrate the top of the head 20, but do not interfere with the pivotal action of the head about the lobes 50,100. Similarly, decorative insignia or ornamentation could conceivably be attached to the base 60.

Alternatively, decorative insignia or ornamentation may be fastened to the base 60 by high temperature soldering, which is sometimes referred to as hand soldering. If the high temperature soldering approach is used, assembly of the device 10 is postponed until after the soldering process is completed in order to prevent thermal damage to the components, especially the springs 40 and 110.

The fastening device 10 can best be made by the lost wax process or by adequate die casting techniques. However, skillful hand carving, although time consuming, is also contemplated.

Only the preferred embodiment of the clothing fastening device is herein disclosed. However, it can readily be appreciated by persons having ordinary skill in the art, that variations of the device may be made without departing from the scope and spirit thereof. Accordingly, the clothing fastening device is not limited, except as defined in the appended claims.

I claim:

1. A fastening apparatus for joining at least two layers of fabric, each layer of fabric having a thru-opening, the apparatus comprising:

a) a first resilient biasing means;

b) a second resilient biasing means;

c) a base member having a shank portion extending from said base member, the shank portion being canted with respect to said base member, the distal end of said shank portion being provided with at least two parallel lobes, each of said lobes being provided with a passageway leading completely therethrough in a direction relatively perpendicular to the length of said shank portion, said base member being of greater geometric proportion than said thru-opening;

d) a smooth rod passing all through said first biasing means, said second biasing means and said parallel lobes;

e) a pivotal member disposed proximate to the distal end of said shank, adapted to receive said smooth rod for retention in one direction against the bias of both said first biasing means and said biasing means spring, to an orientation parallel to the length of said shank portion, said pivotal member being insertable through said opening in said planar sheets of fabric, said pivotal member being of greater geometric proportion than said thru-opening, said pivotal member offset from said shank portion;

f) whereby, after insertion through said fabric opening, said pivotal member is urged by said first and second biasing means to a position relatively perpendicular to said shank portion and parallel to said base member, thereby capturing said fabric layers between said pivotal member and said base member.

2. The apparatus of claim 1, wherein said first resilient biasing means is a coil spring, which biases said pivotal member into a position relatively parallel to said shank portion.

3. The apparatus of claim 1, wherein said second resilient biasing means is a torsion spring, which biases said pivotal member into a position relatively perpendicular to said shank portion.

4. The apparatus of claim 1, wherein said pivotal member includes means to secure a decorative attachment.

5. The apparatus of claim 1, wherein said first biasing means is an open end coil spring having each end thereof inwardly oriented and parallel to the spring coils, such that said ends are directed toward said shank.

6. The apparatus of claim 1, wherein said first resilient biasing means is a closed end coil spring.

7. The apparatus of claim 1, wherein said first resilient biasing means is a ground end coil spring.

8. The apparatus of claim 1, wherein said first resilient biasing means is a disc spring.

9. The apparatus of claim 1, wherein said first resilient biasing means is a spring washer.

10. The apparatus of claim 1, wherein said base member includes means to support a decorative attachment.

11. A method of manufacturing an apparatus for fastening together at least two layers of fabric, each layer of fabric having a thru-opening, the apparatus comprising first and second resilient biasing means, a planar base member having a shank portion extending upwardly therefrom, a hinge pin seated in passageways formed in the distal end of said shank portion and a movable member pivoted about said hinge pin and captivated by same, said movable member resiliently biased to a position perpendicular to said shank by a first biasing means, and said movable member resiliently biased to a position parallel to said shank by a second biasing means, the method comprising:

a) forming said base member and shank portion integral with same;

b) forming said movable member;

c) forming said first biasing means and then said second biasing means;

d) attaching, by high temperature soldering, decorative or ornamental insignia to said base;

e) assembling said apparatus, including the steps of passing said hinge pin through a first opening in said distal end of said shank; and f) positioning said first biasing means upon said hinge pin adjacent said first opening, receiving said second biasing means upon said hinge pin at a position exterior to said distal end of said shank, pressing said hinge pin into a receptacle located on an interior surface of said movable member and seating said movable member securely over said distal end in a pivotal arrangement upon said hinge pin.

12. The method of claim 11, wherein said base member and integral shank are formed by die casting.

13. The method of claim 11, wherein said movable member is formed by die casting.

14. The method of claim 11, wherein said base member and integral shank are formed by the lost wax process.

15. The method of claim 11, wherein said movable member is formed by the lost was process.

* * * * *